US005807477A

United States Patent [19]

Hearn et al.

[11] Patent Number: 5,807,477

[45] Date of Patent: Sep. 15, 1998

[54] PROCESS FOR THE TREATMENT OF LIGHT NAPHTHA HYDROCARBON STREAMS

[75] Inventors: Dennis Hearn; Gary R. Gildert, both of Houston, Tex.

[73] Assignee: Catalytic Distillation Technologies, Pasadena, Tex.

[21] Appl. No.: 717,936

[22] Filed: Sep. 23, 1996

[51] Int. Cl.[6] ..... C10G 29/20; C10G 29/04; C10G 45/34; C07C 5/03

[52] U.S. Cl. ..... 208/238; 208/143; 208/244; 208/85; 585/259; 585/260; 585/21; 585/264; 585/275; 203/DIG. 6

[58] Field of Search ..... 208/143, 145, 208/237, 238, 244, 85; 585/259, 260, 261, 264, 275, 277, 867; 203/DIG. 6

[56] References Cited

U.S. PATENT DOCUMENTS

| | | | |
|---|---|---|---|
| 3,671,603 | 6/1972 | Hagemeyer, Jr. et al. | 260/677 A |
| 3,691,066 | 9/1972 | Carruthers et al. | 208/255 R |
| 3,884,984 | 5/1975 | Hirose et al. | 260/634 |
| 3,960,683 | 6/1976 | Baba | 204/158 R |
| 4,055,483 | 10/1977 | Mertzweiller et al. | 208/213 |
| 4,113,603 | 9/1978 | Bauer | 208/89 |
| 4,123,502 | 10/1978 | Holter et al. | 423/230 |
| 4,194,964 | 3/1980 | Chen et al. | 208/108 |
| 4,451,607 | 5/1984 | Garcia et al. | 524/494 |
| 4,486,297 | 12/1984 | Matsumoto et al. | 208/211 |
| 4,676,887 | 6/1987 | Fischer et al. | 208/61 |
| 4,690,806 | 9/1987 | Schorfheide | 423/230 |
| 4,731,229 | 3/1988 | Sperandio | 422/188 |
| 4,827,076 | 5/1989 | Kokayeft et al. | 585/737 |
| 4,941,968 | 7/1990 | Reid | 208/236 |
| 4,990,242 | 2/1991 | Louie et al. | 208/218 |
| 5,009,770 | 4/1991 | Miller et al. | 208/209 |
| 5,073,236 | 12/1991 | Gelbein et al. | 203/29 |
| 5,084,259 | 1/1992 | Satek et al. | 423/277 |
| 5,124,027 | 6/1992 | Beaton et al. | 208/309 |
| 5,154,817 | 10/1992 | Reid | 208/48 AA |
| 5,266,546 | 11/1993 | Hearn | 502/300 |
| 5,290,427 | 3/1994 | Fletcher et al. | 289/89 |
| 5,320,742 | 6/1994 | Fletcher et al. | 208/89 |
| 5,321,163 | 6/1994 | Hickey et al. | 568/59 |
| 5,322,615 | 6/1994 | Holtermann et al. | 208/91 |
| 5,348,641 | 9/1994 | Shih | 208/89 |
| 5,431,888 | 7/1995 | Hickey et al. | 422/191 |
| 5,431,890 | 7/1995 | Crossland et al. | 422/211 |
| 5,510,568 | 4/1996 | Hearn | 585/834 |
| 5,595,634 | 1/1997 | Hearn et al. | 203/29 |
| 5,597,476 | 1/1997 | Hearn et al. | 208/208 R |

*Primary Examiner*—Glenn Caldarola
*Assistant Examiner*—Thuan D. Dang
*Attorney, Agent, or Firm*—Kenneth H. Johnson

[57] ABSTRACT

A process for treating a light cracked naphtha to be used as an etherification or alkylation feedstock in which the mercaptans and diolefins reacted in a single pass fixed bed reactor and are removed in a distillation column reactor which hydrogenate the unreacted diolefins. The mercaptans are reacted with the diolefins to form sulfides which are higher boiling than that portion of the naphtha which is used as feed to the etherification or alkylation unit. The higher boiling sulfides are removed as bottoms along with any $C_6$ and heavier materials. Any diolefins not converted to sulfides are selectively hydrogenated to mono-olefins for use in the etherification process. Certain $C_5$ olefins, for example pentene-1 and 3-methyl butene-1 are isomerized during the process to more beneficial isomers.

13 Claims, 1 Drawing Sheet

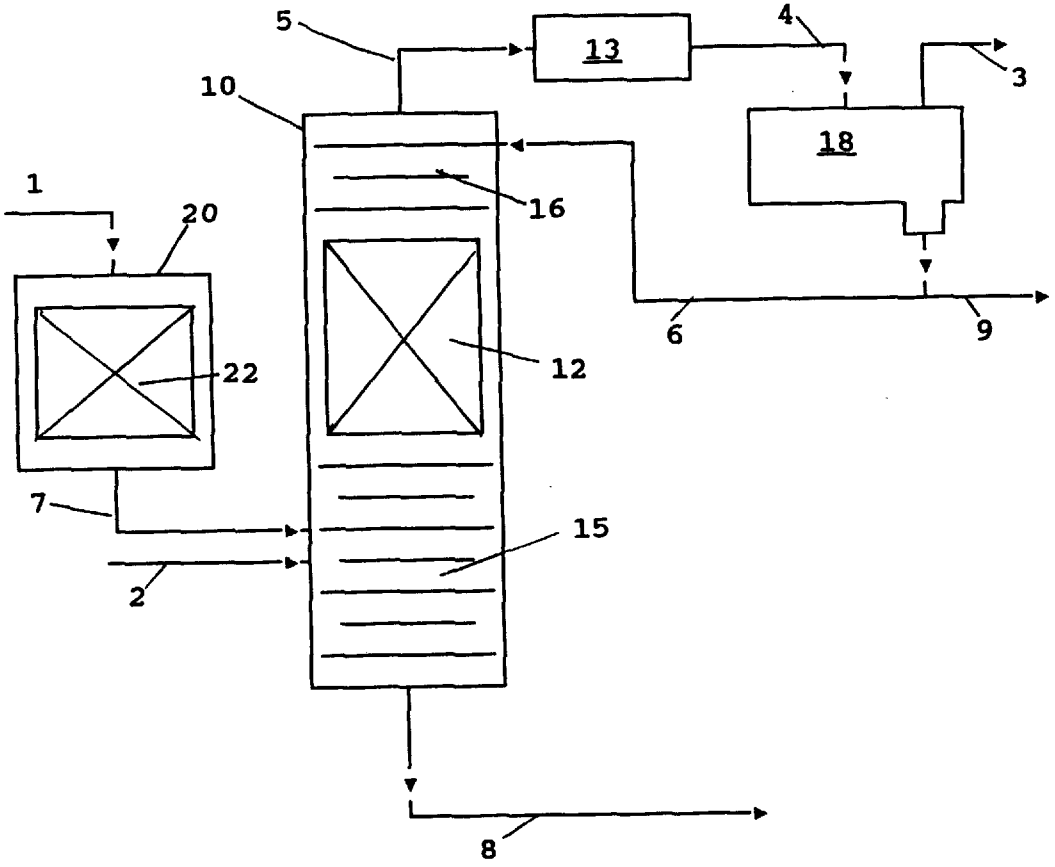
1
20
22
10
5
13
4
3
18
9
6
16
12
15
7
2
8

PROCESS FOR THE TREATMENT OF LIGHT NAPHTHA HYDROCARBON STREAMS

BACKGROUND OF THE INVENTION

1. Field of the Invention

The present invention relates generally to a process for the removal of mercaptans and hydrogenation of diolefins from petroleum distillate streams. More particularly the invention relates to a process combining the attributes of the fixed bed straight pass reactor and catalytic distillation system.

2. Related Information

Petroleum distillate streams contain a variety of organic chemical components. Generally the streams are defined by their boiling ranges which determine the compositions. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

The petroleum distillates often contain unwanted contaminants such as heavy metals, sulfur and nitrogen compounds. These contaminants often are catalyst poisons or produce undesirable products upon further processing. In particular the sulfur compounds can be troublesome. The sulfur compounds are known catalyst poisons for naphtha reforming catalysts and hydrogenation catalysts. The sulfur compounds present in a stream are dependent upon the boiling range of the distillate. In a light naphtha (110°–250° F. boiling range) the predominant sulfur compounds are mercaptans. The most common method for removal of the $H_2S$ and mercaptans is caustic washing of the organic streams.

Another method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \rightarrow RH+H_2S \quad (1)$$

$$RCl+H_2 \rightarrow RH+HCl \quad (2)$$

$$2RN+4H_2 \rightarrow RH+NH_3 \quad (3)$$

Typical operating conditions for the HDS reactions are:

| | |
|---|---|
| Temperature, °F. | 600–780 |
| Pressure, psig | 600–3000 |
| $H_2$ recycle rate, SCF/bbl | 1500–3000 |
| Fresh $H_2$ makeup, SCF/bbl | 700–1000 |

As may be seen the emphasis has been upon hydrogenating the sulfur and other contaminating compounds. The sulfur is then removed in the form of gaseous $H_2S$, which in itself is a pollutant and requires further treatment.

In the production of tertiary amyl methyl ether (TAME) for use as a gasoline additive generally a light cracked naphtha (LCN) is used as the source of the olefins for the etherification reaction. This LCN may contain sulfur as a contaminant in the form of mercaptans in concentrations of up to hundreds wppm. These mercaptans are inhibitors for the hydrogenation catalyst used to hydrogenate diolefins in the feed to an etherification unit or to an alkylation unit. As noted above, one common method to remove the sulfur compounds has been caustic extraction.

SUMMARY OF THE INVENTION

The present invention presents a new process for the removal of mercaptans from aliphatic hydrocarbon streams, containing 4 to 12 carbon atoms. Most particularly the invention relates to a process wherein the reaction of the mercaptans with a portion of the diolefins is carried out in a single pass fixed bed reactor and preferably the remaining diolefins are subsequently hydrogenated in a distillation column reactor where the sulfides are simultaneously removed by fractional distillation to remove the sulfides, and thus the sulfur, from the distillate.

A light cracked naphtha stream which is used as a feed to an etherification or alkylation unit is a preferred feed for this process. The light cracked naphtha contains $C_4$ to $C_8$ components, mostly $C_5$ compounds, which may be saturated (alkanes), unsaturated (olefins) and polyunsaturated (diolefins) along with minor amounts of the mercaptans. The light naphtha is generally depentanized in a fractional distillation column to remove that portion containing the $C_6$ and higher boiling materials ($C_6$+) as bottoms and the $C_5$ and lower boiling materials ($C_5$−) as overheads. One embodiment of the present invention utilizes the upper portion of the depentanizer to hydrogenate substantially all of the diolefins contained in the stream. Prior to the hydrogenation the stream is passed through a single pass fixed bed reactor where all of the mercaptans contained in the light cracked naphtha are reacted with a portion of the diolefins to form sulfides. The effluent from the single pass fixed bed reactor is then fed to a distillation column reactor acting as a depentanizer where the $C_6$+ and the disulfides which are higher boiling than the $C_5$ fraction containing the amylenes are separated and the amylenes are fed to the etherification unit. The sulfides are removed as bottoms from the depentanizer column along with the $C_6$+ fraction and can be simply remixed into the final gasoline fraction.

The single pass fixed reactor acts as a guard bed removing the bulk of the mercaptans and capturing any heavy metal or other contaminants. Because of the configuration, the catalyst in the single pass fixed bed reactor can be replaced easily and thus acts as a guard bed for the more expensive catalytic distillation structure in the distillation column reactor.

The preferred catalyst for the mercaptan/diolefin reaction is nickel on a silica base. The catalyst typically contains between 40–60% by weight of nickel.

The catalyst used for the diolefin hydrogenation reaction is preferably palladium oxide, preferably 0.1 to 1.0 wt % on an alumina base which has been configured as a catalytic distillation structure.

Hydrogen is provided as necessary to the distillation column reactor to support the reaction and, it is believed, to reduce the oxide and maintain it in the hydride state. The distillation column reactor is operated at a pressure such that the reaction mixture is boiling in the bed of catalyst. A "froth level" may be maintained throughout the catalyst bed by control of the bottoms and/or overheads withdrawal rate which may improve the effectiveness of the catalyst thereby decreasing the height of catalyst needed. As may be appreciated the liquid is boiling and the physical state is actually a froth having a higher density than would be normal in a packed distillation column but less than the liquid without the boiling vapors.

The present process preferably operates at overhead pressure of said distillation column reactor in the range between 0 and 250 psig and temperatures within said distillation reaction zone in the range of 100° to 300° F., preferably 130° to 270° F.

The feed and the hydrogen are preferably fed to the distillation column reactor separately or they may be mixed prior to feeding. A mixed feed is fed below the catalyst bed or at the lower end of the bed. Hydrogen alone is fed below the catalyst bed and the hydrocarbon stream is fed below the bed to about the mid one-third of the bed. The pressure selected is that which maintains catalyst bed temperature between 100° F. and 300° F.

BRIEF DESCRIPTION OF THE DRAWING

The FIGURE is a simplified flow diagram of one embodiment of the invention.

DESCRIPTION OF THE PREFERRED EMBODIMENTS

The present invention provides a process for the reaction of a portion of the diolefins within a petroleum distillate with the mercaptans within the distillate to form sulfides and subsequent hydrogenation of the remaining diolefins with concurrent separation of the higher boiling sulfides from the distillate.

This requires a fixed bed single pass reactor containing a suitable catalyst for reacting the diolefins with the mercaptans and a distillation column reactor which contains an appropriate hydrogenation catalyst in the form of a catalytic distillation structure.

The $C_5$'s in the feed to the present unit are contained in a single "light naphtha" cut which may contain everything from $C_5$'s through $C_8$'s and higher. This mixture can easily contain 150 to 200 components. Mixed refinery streams often contain a broad spectrum of olefinic compounds. This is especially true of products from either catalytic cracking or thermal cracking processes. Refinery streams are usually separated by fractional distillation, and because they often contain compounds that are very close in boiling points, such separations are not precise. A $C_5$ stream, for instance, may contain $C_4$'s and up to $C_8$'s. These components may be saturated (alkanes), unsaturated (mono-olefins), or polyunsaturated (diolefins). Additionally, the components may be any or all of the various isomers of the individual compounds. Such streams typically contain 15 to 30 weight % of the isoamylenes(total methyl butene isomers).

Such refinery streams also contain small amounts of sulfur which must be removed. Hydrogen sulfide ($H_2S$) which is frequently a component of the refinery stream is removed with the $C_3/C_4$ fraction. The sulfur compounds are generally found in a light cracked naphtha stream as mercaptans which poison the hydrogenation catalyst used to selectively hydrogenate diolefins. Removal of sulfur compounds is generally termed "sweetening" a stream.

Several of the minor components (diolefins) in the feed will react slowly with oxygen during storage to produce "gum" and other undesirable materials. However, these components also react very rapidly in the TAME process to form a yellow, foul smelling gummy material and consume acid in an alkylation unit. Thus, it is seen to be desirable to remove these components whether the "light naphtha" cut is to be used only for gasoline blending by itself or as feed to a TAME or alkylation process.

Catalysts which are useful in the mercaptan-diolefin reaction and hydrogenation reaction include the Group VIII metals. Generally the metals are deposited as the oxides on an alumina support. The supports are usually small diameter extrudates or spheres. The catalyst must then be prepared in the form of a catalytic distillation structure.

The catalyst used in the distillation column reactor is a catalytic distillation structure and must be able to function as catalyst and as mass transfer medium. The catalyst must be suitably supported and spaced within the column to act as a catalytic distillation structure. In a preferred embodiment the catalyst is contained in a woven wire mesh structure as disclosed in U.S. Pat. No. 5,266,546 which is hereby incorporated by reference. Other catalytic distillation structures useful for this purpose are disclosed in U.S. Pat. Nos. 4,731,229 and 5,073,236 which are also incorporated by reference.

Suitable catalyst for the reaction of the diolefins with mercaptans is an alumina or silica supported nickel catalyst containing from 40–60% by weight nickel. A preferred catalyst for the mercaptan-diolefin reaction is 54 wt % Ni on 1/16 silica extrudate, supplied by United Catalysts Inc., designated as T-2576.

Suitable catalysts for the hydrogenation reaction are 0.34 wt % Pd on 7 to 14 mesh $Al_2O_3$ (high purity alumina) spheres, designated as G-68C and 0.4 wt % Pd on 7 to 14 mesh alumina spheres designated as G-68C-1, supplied by United Catalysts Inc.

The catalyst in the reaction distillation column is believed to be the hydride of palladium which is produced during operation. The hydrogen rate to the reactor must be sufficient to maintain the catalyst in the active form because hydrogen is lost from the catalyst by hydrogenation and support the hydrogenation reaction, but kept below that which would cause flooding of the column which is understood to be the "effectuating amount of hydrogen" as that term is used herein. Generally the mole ratio of hydrogen to diolefins and acetylenes in the feed is at least 1.0 to 1.0 and preferably at least 2.0 to 1.0 and more preferably at least 10.0 to 1. The catalyst catalyzes the selective hydrogenation of the acetylenes and diolefins contained within the light cracked naphtha and to a lesser degree the isomerization of some of the mono-olefins. Generally the relative absorption preference is as follows:

(1) Sulfur compounds (2) diolefins (3) mono-olefins

If the catalyst sites are occupied by a more strongly absorbed species, reaction of these weaker absorbed species cannot occur. Thus the sulfur compounds are preferably removed prior to the hydrogenation reaction.

The first reaction of interest is the reaction of the mercaptans with diolefins. The equation of interest which describes the reaction is:

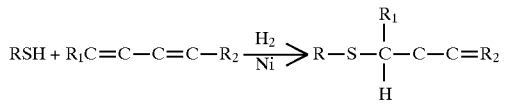

Where R, $R_1$ and $R_2$ are independently selected from hydrogen and hydrocarbyl groups of 1 to 20 carbon atoms.

This may be compared to the hydrodesulfurization (HDS) reaction which consumes hydrogen. No hydrogen is consumed in the removal of the mercaptans in the present invention.

Typical of the mercaptan compounds which may be found to a greater or lesser degree in a light cracked naphtha are: methyl mercaptan (b.p. 43° F.), ethyl mercaptan (b.p. 99° F.), n-propyl mercaptan (b.p. 154° F.), iso-propyl mercaptan (b.p. 135°–140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), iso-amyl mercaptan (b.p. 250° F.), n-amyl mercaptan (b.p. 259° F.), α-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F. at 20 mm Hg).

Typical diolefins in the $C_5$ boiling range fraction include: isoprene (2-methyl butadiene-1,3), cis and trans piperylenes (cis and trans 1,3-pentadienes), cyclopentadiene, and minor amounts of butadienes. Analogous dienes exist throughout the range of hydrocarbons useful in the present process.

In the $C_5$ streams, there are several $C_5$ olefin isomers, some being less desirable in the etherifications and alkylations to which the streams are dedicated. In the present process at least two of the lesser desired isomers, pentene-1 and 3-methyl butene-1 are isomerized to pentene-2 and 2-methyl butene-2, respectively.

The hydrogenation of the present invention can be carried out in a catalyst packed column which can be appreciated to contain a vapor phase ascending and some liquid phase as in any distillation. However since the liquid is held up within the column by artificial "flooding", it will be appreciated that there is an increased density over that when the liquid is simply descending because of what would be normal internal reflux.

Referring now to the FIGURE there is depicted a simplified flow diagram of one embodiment of the invention.

Light cracked naphtha is fed via flow line 1 to a single pass fixed bed reactor 20 containing a bed of alumina supported nickel catalyst. In the reactor 20 the mercaptans react with a portion of the diolefins in the naphtha to form sulfides. The reactor is operated at pressure of 150 psig and temperatures of between 300° and 350° F. and LHSV of 10 $hr^{-1}$ High weight hourly space velocities (WHSV=weight of feed per hour per volume of catalyst) are possible with the high nickel content catalyst. Space velocities in the range of 5 to 30 are preferred.

The effluent from the reactor 20 and hydrogen are fed to a depentanizer configured as a distillation column reactor 10 via flow lines 7 and 2 respectively. The $C_6$ and heavier materials, including the higher boiling sulfides are removed in the lower stripping section 15. The $C_5$ and lighter material, including the unreacted diolefins, are distilled up into the reaction distillation zone 12 containing the catalytic distillation structure. In the reaction distillation zone 12 substantially all of the remaining diolefins or other polyolefins, such as acetylenes, are hydrogenated. A rectifying section 16 is provided to insure separation of the sulfides.

The $C_5$ and lighter distillate ($C_5$–), less the mercaptans, are removed as overheads via flow line 5 and passed through condenser 13 where the condensible materials are condensed. The liquids are collected in accumulator 18 where the gaseous materials, including any unreacted hydrogen, are separated and removed via flow line 3. The unreacted hydrogen may be recycled (not shown) if desired. The liquid distillate product is removed via flow line 9. Some of the liquid is recycled to the column 10 as reflux via line 6.

The distillation column reactor is operated at pressures to give catalyst bed temperatures of between 100° and 180° F.

Generally the $C_5$ and lighter material will be used as feed stock for a etherification unit where the isoamylenes contained therein will be converted to TAME or tertiary amyl ethyl ether (TAEE). This TAME or TAEE is recombined with the $C_6$ bottoms (removed as bottoms via flow line 8) and sent to gasoline blending. While the $C_6$ and heavier materials contain the sulfides, the total sulfur content is still acceptably low.

In another embodiment a light naphtha hydrocarbon stream containing mercaptan, hydrogen sulfide and diolefins is fed to a single pass fixed bed reactor containing a Group VIII metal oxide catalyst to react substantially all of the mercaptans with a portion of the diolefins to form sulfides; the effluent from the single pass fixed bed reactor is fed to a distillation column; where said sulfides are separated from said distillate product by fractional distillation; the distillate product is withdrawn from said distillation column as overhead, said distillate product having a reduced mercaptan content and a reduced diolefin content; and the sulfide products are withdrawn from said distillation column as bottoms.

EXAMPLE 1

In the fixed bed guard bed reactor the catalyst was 10 grams of T-2576. The reactor was a 6 inch ⅝" ID pipe in a sand bath heater. The conditions were: Pressure was 150 psig, temp. 300° F., hydrogen feed 10 sccm and FCC feed rate 1.6 ml/min (10 WHSV).

Two product samples were taken for analysis for sulfur. The results are set out in the following TABLE.

TABLE

| Stream | Feed | Product | |
|---|---|---|---|
| Total Hours | | 30.5 | 55.0 |
| SULFUR ANALYSIS, ppm | | | |
| hydrogen sulfide | 5.95 | 5.12 | 4.58 |
| carbon oxide sulfide | 1.06 | 1.14 | 0.37 |
| methanethiol | 0.40 | 0.46 | 0.67 |
| dimethyl sulfide | 0.59 | 0.77 | 0.00 |
| ethanethiol | 29.60 | 8.26 | 13.25 |
| carbon disulfide | 0.33 | 0.00 | 0.00 |
| 2-propanethiol | 17.25 | 4.83 | 7.99 |
| 2-methyl-2-propanethiol | 0.27 | 0.09 | 0.20 |
| 1-propanethiol | 1.55 | 1.71 | 1.85 |
| ethyl,methyl sulfide | 17.15 | 3.81 | 6.66 |
| 2-methyl-1-propanethiol | 1.55 | 0.00 | 0.62 |
| 1-butanethiol | 3.75 | 1.32 | 1.88 |
| thiophene | 73.43 | 67.30 | 74.30 |
| 2-butanethiol | 0.00 | 0.10 | 0.09 |
| dimethyl disulfide | 0.00 | 0.09 | 0.03 |
| 2-methylthiophene | 70.45 | 65.65 | 76.61 |
| 2-ethylthiophene | 13.09 | 12.87 | 15.80 |
| 3-methylthiophene | 74.36 | 71.51 | 80.13 |
| 1-pentanethiol | 0.65 | 2.40 | 4.10 |
| tetrahydrothiophene | 22.69 | 28.86 | 32.52 |
| diethyl disulfide | 1.51 | 3.37 | 2.79 |
| di-sec-butyl sulfide | 4.78 | 5.65 | 11.48 |
| dibutyl sulfide | 16.16 | 0.00 | 18.29 |
| methylthiocresol | 1.56 | 10.66 | 2.94 |
| benzothiophene | 98.67 | 97.01 | 112.59 |
| thiophenol | 13.70 | 8.54 | 15.06 |
| dibenzothiophene | 0.12 | 0.00 | 0.15 |
| unknown sulfur | 577.52 | 609.51 | 742.19 |
| total sulfur | 1048.14 | 1011.03 | 1227.14 |

The invention claimed is:

1. A process for treating a light naphtha hydrocarbon stream, comprising the steps of:

(a) feeding a light naphtha hydrocarbon stream containing mercaptan, hydrogen sulfide and diolefins to a single pass fixed bed reactor containing a Group VIII metal oxide catalyst to react substantially all of the mercaptans with a portion of the diolefins to form sulfides;

(b) feeding the effluent from the single pass fixed bed reactor and hydrogen to a distillation column reactor;

(c) concurrently in said distillation column reactor (i) contacting the remaining diolefins with hydrogen in in the presence of a supported Group VIII metal oxide catalyst thereby hydrogenating a portion of said diolefins to produce a distillate product having lower diolefin content than said effluent;

(ii) separating said sulfides from said distillate product by fractional distillation;

(d) withdrawing distillate product from said distillation column reactor at a point above said distillation reaction zone, said distillate product having a reduced mercaptan content and a reduced diolefin content; and (e) withdrawing sulfide products from said distillation column reactor at a point below said distillation reaction zone.

2. The process according to claim 1 wherein said hydrocarbon stream is a light cracked naphtha distillate containing a $C_5$ and lighter fraction and a $C_6$ and heavier fraction, said $C_5$ and lighter fraction is removed as overheads from said distillation column reactor and said $C_6$ and heavier fraction is removed as bottoms from said distillation column reactor.

3. The process according to claim 1 wherein there is a molar excess of diolefins to mercaptans.

4. The process according to claim 3 wherein substantially all of said mercaptans are reacted with diolefins to form sulfide products and said distillate product is substantially mercaptan free.

5. The process according to claim 3 wherein substantially all of said excess of diolefins not reacted with mercaptans are hydrogenated to mono-olefins.

6. A process for treating a light cracked naphtha distillate for use as an etherification and/or alkylation feed stock, comprising the steps of:

(a) feeding a light cracked naphtha distillate containing mercaptans and diolefins to a single pass fixed bed reactor containing a Group VIII metal oxide whereby substantially all of said mercaptans are reacted with a portion of said diolefins to form sulfides;

(b) feeding the effluent from said single pass fixed bed reactor to a distillation column reactor having a stripping zone and distillation reaction zone, said effluent having a $C_6$+fraction and a $C_5$− fraction;

(c) feeding hydrogen to said distillation column reactor;

(d) separating said $C_6$+fraction from said $C_5$− fraction in said stripping zone and distilling said $C_5$− fraction up into said distillation reaction zone;

(e) concurrently in said distillation reaction zone (i) contacting the unreacted diolefins and hydrogen in the presence of a Group VIII metal oxide catalyst supported on a particulate alumina base thereby hydrogenating substantially all of the unreacted diolefins to a distillate product, (ii) separating said sulfides from said distillate product by fractional distillation;

(f) withdrawing a $C_5$− distillate product from said distillation column reactor as overheads, said $C_5$− distillate product having a reduced hydrogen sulfide, mercaptan and diolefin content; and (g) withdrawing said sulfide products from said distillation column reactor as bottoms along with said $C_6$+ fraction.

7. The process according to claim 6 wherein there is a molar excess of diolefins to mercaptans within said light cracked naphtha stream.

8. The process according to claim 6 wherein substantially all of said mercaptans react with diolefins to produce sulfide products producing a substantially mercaptan free $C_5$− distillate product.

9. The process according to claim 6 wherein said cracked light naphtha contains pentene-1 and 3-methyl butene-1 said pentene-1 and 3-methyl butene-1 being isomerized to pentene-2 and 2-methyl butene-2, respectively by said Group VIII metal oxide catalyst in said distillation reaction zone.

10. The process according to claim 6 wherein said Group VIII metal in step (a) is nickel and the Group VIII metal in step (e)(i) is palladium.

11. A process for treating a light naphtha hydrocarbon stream, comprising the steps of:

(a) feeding a light naphtha hydrocarbon stream containing mercaptan, hydrogen sulfide and diolefins to a single pass fixed bed reactor containing a Group VIII metal oxide catalyst to react substantially all of the mercaptans with a portion of the diolefins to form sulfides;

(b) feeding the effluent from the single pass fixed bed reactor to a distillation column;

(c) separating said sulfides from said distillate product by fractional distillation;

(d) withdrawing distillate product from said distillation column overhead, said distillate product having a reduced mercaptan content and a reduced diolefin content; and (e) withdrawing sulfide products from said distillation column as bottoms.

12. The process according to claim 1 wherein said catalyst in step (c) (i) is prepared in a form to act as a catalytic distillation structure.

13. The process according to claim 6 wherein said catalyst in step (e) (i) is prepared in a form to act as a catalytic distillation structure.

* * * * *